US009931691B2

(12) United States Patent
Okada et al.

(10) Patent No.: US 9,931,691 B2
(45) Date of Patent: Apr. 3, 2018

(54) MOLDING METHOD OF SAND MOLD USING FOAMED SAND, MOLDING DIE, AND SAND MOLD

(71) Applicant: TOYOTA JIDOSHA KABUSHIKI KAISHA, Toyota-shi, Aichi-ken (JP)

(72) Inventors: Masaki Okada, Chiryu (JP); Masaomi Mitsutake, Toyota (JP); Hirotsune Watanabe, Miyoshi (JP); Masashi Morikawa, Seto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 108 days.

(21) Appl. No.: 15/029,116

(22) PCT Filed: Oct. 15, 2014

(86) PCT No.: PCT/IB2014/002111
§ 371 (c)(1),
(2) Date: Apr. 13, 2016

(87) PCT Pub. No.: WO2015/056078
PCT Pub. Date: Apr. 23, 2015

(65) Prior Publication Data

US 2016/0236269 A1 Aug. 18, 2016

(30) Foreign Application Priority Data

Oct. 17, 2013 (JP) ..... 2013-216514

(51) Int. Cl.
*B22C 9/02* (2006.01)
*B22C 9/10* (2006.01)
*B22C 13/08* (2006.01)

(52) U.S. Cl.
CPC ..... *B22C 9/02* (2013.01); *B22C 9/10* (2013.01); *B22C 9/108* (2013.01); *B22C 13/08* (2013.01)

(58) Field of Classification Search
CPC .. B22C 9/02; B22C 9/10; B22C 9/108; B22C 13/08
See application file for complete search history.

(56) References Cited

U.S. PATENT DOCUMENTS 8,029,614 B2 * 10/2011 Zenpo ..... B22C 1/22 106/38.2
2010/0140823 A1 6/2010 Asano et al.
2014/0284015 A1 9/2014 Mitsutake et al.

FOREIGN PATENT DOCUMENTS

JP H10-5933 A 1/1998
JP 2013-111602 A 6/2013
(Continued)

*Primary Examiner* — Kevin E Yoon
(74) *Attorney, Agent, or Firm* — Oliff PLC

(57) ABSTRACT

A molding method of a sand mold including a hardened layer in a predetermined thickness range from an outer layer part, includes: forming a cavity and a filling opening of a die so that a dimension, which is a largest dimension between two intersections of straight lines passing through a section of a boundary portion between the cavity and the filling opening of the die, with respect to an outside line of the section, is less than a predetermined ratio with respect to a thickness dimension of that part of a product portion of the sand mold from which a blowing opening molded in the filling opening projects, the product portion being formed by the cavity of the die; and filling foamed sand into the cavity from the filling opening of the die.

4 Claims, 3 Drawing Sheets

(56) References Cited

FOREIGN PATENT DOCUMENTS

| | | | |
|---|---|---|---|
| JP | 2013-151008 | A | 8/2013 |
| JP | 2013-169582 | A | 9/2013 |

* cited by examiner

MOLDING METHOD OF SAND MOLD USING FOAMED SAND, MOLDING DIE, AND SAND MOLD

BACKGROUND OF THE INVENTION

1. Field of the Invention

The present invention relates to a sand mold using foamed sand, a molding method of a sand mold, and a molding die for a sand mold.

2. Description of Related Art

On molding a product having a hollow portion, a collapsible sand core is used. As a molding method of a sand core, a technique using foamed sand obtained such that binder containing water glass is stirred with an aggregate so as to be foamed has been developed (for example, Japanese Patent Application Publication No. 2013-169582 (JP 2013-169582 A), Japanese Patent Application Publication No. 2013-111602 (JP 2013-111602 A)). In the technique, a sand-mold molding device 1 illustrated in FIG. 3 is used. The sand-mold molding device 1 is to mold a sand core (sand mold) for aluminum casting, for example, by hardening foamed sand S, and includes a die 2 having a cavity C for molding the sand core, and a filling device 3 for filling the foamed sand S into the cavity C of the die 2.

The die 2 is to form the cavity C by clamping an upper die and a lower die. The die 2 is provided with a filling opening 5 for communicating the cavity C with a sand tank 12 of the filling device 3. The filling device 3 includes a sand tank 12 for mixing and accumulating the foamed sand S and pressurization mechanism (pressurizing means) 13 for pressurizing the foamed sand S in the sand tank 12. Then, the die 2 is set in the sand tank 12, and the foamed sand S in the sand tank 12 is pressurized by the pressurization mechanism 13, so that the foamed sand S is filled into the cavity C of the die 2 via the filling opening 5. The die 2 is heated to around 150° C. to 300° C., so as to vaporize water in the foamed sand S filled in the cavity C, thereby solidifying the foamed sand S. After that, the die 2 is opened and a sand core molded hereby is taken out therefrom.

As described above, when the foamed sand S is filled into the cavity C of the die 2 so as to perform molding, an internal pressure of the cavity C of the die 2 is increased due to evaporation of water and thermal expansion of air bubble in a heating and hardening process of the foamed sand S. Hereby, water glass and an aggregate are accumulated in an outer layer part of a molded product, so that a minute hardened layer having a necessary strength is formed in a predetermined thickness range from the outer layer part of the molded product. As a result, a vulnerable portion that is fragile due to a low density is formed inside the molded product. Further, when the density is markedly unbalanced, the vulnerable portion may become hollow. When the sand core is used for casting, the strength required for the sand core is secured by the hardened layer, and the vulnerable portion or hollow portion contributes to collapsibility after the casting, thereby making it possible to take out the core from a casting product.

SUMMARY OF THE INVENTION

In the meantime, when the foamed sand S is filled into the cavity C of the die 2 so as to perform molding, the filling opening 5 for sending the foamed sand S into the cavity C is also filled with the foamed sand S, and the foamed sand S in the filling opening 5 is also heated and hardened. Accordingly, a hardened layer is formed in a predetermined thickness range from an outer layer part of the foamed sand S (a blowing opening) thus hardened in the filling opening 5, and a vulnerable portion or hollow portion is formed thereinside. The blowing opening is integrated with a product portion, and is removed at the time of casting. However, if the vulnerable portion or hollow portion of the blowing opening continues with the hollow portion of the product portion, the hollow portion of the product portion is exposed on a surface of the product portion by removing the blowing opening. As a result, molten metal might flow into the hollow portion of the sand mold from the vulnerable portion or hollow portion of the blowing opening.

The present invention provides a molding method of a sand mold using foamed sand, a molding die, and a sand mold, each of which restrains molten metal from flowing into the sand mold from a vulnerable portion or hollow portion of that blowing opening of the sand mold using the foamed sand which is exposed on a surface of a product portion.

Aspect of Invention

The following aspects of the invention exemplify configurations of the present invention, and are described in an itemized manner in order to facilitate the understanding of the various configurations of the present invention. Each item does not limit the technical scope of the present invention, and the technical scope of the present invention may include configurations in which constituents of each item are partially replaced, omitted, or supplemented by additional constituents while taking into consideration embodiments of the present invention.

A first aspect of the present invention relates to a molding method of a sand mold including a hardened layer in a predetermined thickness range from an outer layer part. The molding method of a sand mold including a hardened layer in a predetermined thickness range from an outer layer part, includes: forming a cavity and a filling opening of a die so that a dimension b, which is a largest dimension between two intersections of straight lines passing through a section of a boundary portion between the cavity and the filling opening of the die, with respect to an outside line of the section, is less than a predetermined ratio with respect to a thickness dimension d of that part of a product portion of the sand mold from which a blowing opening molded in the filling opening projects, the product portion being formed by the cavity of the die; and filling foamed sand into the cavity from the filling opening of the die.

According to the above aspect, the foamed sand filled into the cavity via the filling opening of the die has a structure including a hardened layer within a predetermined thickness range from the outer layer part not only in the cavity but also in the filling opening. That is, the product portion and the blowing opening of the sand mold are each constituted by the hardened layer, and a vulnerable portion or hollow portion. Further, the product portion and the blowing opening are each configured such that a thickness of the vulnerable portion or hollow portion is generally one-third of a whole thickness of the product portion or the blowing opening, and a thickness of each hardened layer covering the vulnerable portion or hollow portion is generally one-third of the whole thickness. Although a boundary between the vulnerable portion and the hardened layer does not necessarily appear clearly, the thicknesses at the time when a minute range having a necessary strength is assumed the hardened layer have the abovementioned values. The present aspect focuses on a relationship between a dimension of the product portion of the sand mold and a dimension of the blowing opening thereof on molding the sand mold by use of the foamed sand.

More specifically, the present aspect focuses on a ratio between (i) the dimension b, which is a largest dimension between two intersections of the straight lines passing through the section of the boundary portion between the cavity and the filling opening, of the die, with respect to the outside line of the section, and (ii) the thickness dimension d of that part of the product portion of the sand mold from which the blowing opening molded in the filling opening projects, the product portion being formed by the cavity of the die. Then, the cavity and the filling opening of the die are configured such that the dimension b is less than a predetermined ratio with respect to the dimension d. When the foamed sand is filled into the cavity from the filling opening of the die thus configured so as to perform molding, a sufficient thickness for the hardened layer in that part of the product portion from which the blowing opening is removed is secured. This inhibits molten metal from flowing into the sand mold from the vulnerable portion or hollow portion of the blowing opening exposed on a surface of the product portion of the sand mold.

In the above aspect, values of b and d may be set so as to satisfy $b<d/2$. In the present aspect, a relationship of the values of the dimension b and the dimension d is set to $b<d/2$, and the foamed sand is filled into the cavity from the filling opening of the die, so as to perform molding. In the dimensional relationship, the foamed sand is filled into the cavity from the filling opening of the die, so as to perform molding. In a state where the blowing opening is removed from the product portion, a sufficient thickness is secured for the hardened layer of a part where the blowing opening is removed. This prevents molten metal from flowing into the sand mold from the vulnerable portion or hollow portion of the blowing opening exposed to the surface of the product portion.

A second aspect of the present invention relates to a molding die for molding a sand mold including a hardened layer in a predetermined thickness range from an outer layer part. The molding die includes a cavity, and a filling opening communicating with the cavity and configured to fill the foamed sand into the cavity. The cavity and the filling opening are configured such that a dimension b, which is a largest dimension between two intersections of straight lines passing through a section of a boundary portion between the cavity and the filling opening, with respect to an outside line of the section, is less than a predetermined ratio with respect to a thickness dimension d of that part of a product portion of the sand mold from which a blowing opening molded in the filling opening projects, the product portion being formed by the cavity of the die.

In the above aspect, values of b and d may be set so as to satisfy $b<d/2$.

A third aspect of the present invention relates to a sand mold molded by filling foamed sand into a cavity from a filling opening of a die so that the sand mold includes a hardened layer in a predetermined thickness range from an outer layer part. The sand mold includes: a product portion molded in the cavity of the die, and a blowing opening molded in the filling opening. A dimension b, which is a largest dimension between two intersections of straight lines passing through a section of a boundary portion between the product portion and the blowing opening, with respect to an outside line of the section is less than a predetermined ratio with respect to a thickness dimension d of that part of the product portion from which the blowing opening projects.

In the above aspect, values of b and d may be set so as to satisfy $b<d/2$.

When the molding die according to the second aspect is used in the molding method of the sand mold according to the first aspect, it is possible to obtain the same effect as the effect of the molding method of a sand mold according to the first aspect. Further, the sand mold according to the third aspect is obtainable by performing the molding method of a sand mold according to the first aspect, or obtainable by performing molding by, use of the molding die according to the second aspect. Note that when the sand mold according to the third aspect is used for casting, the blowing opening is removed.

Since the first to third aspects of the present invention are configured as such, it is possible to restrain molten metal from flowing into the sand mold from the vulnerable portion or hollow portion of that blowing opening of the sand mold using the foamed sand which is exposed on the surface of the product portion.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 3:
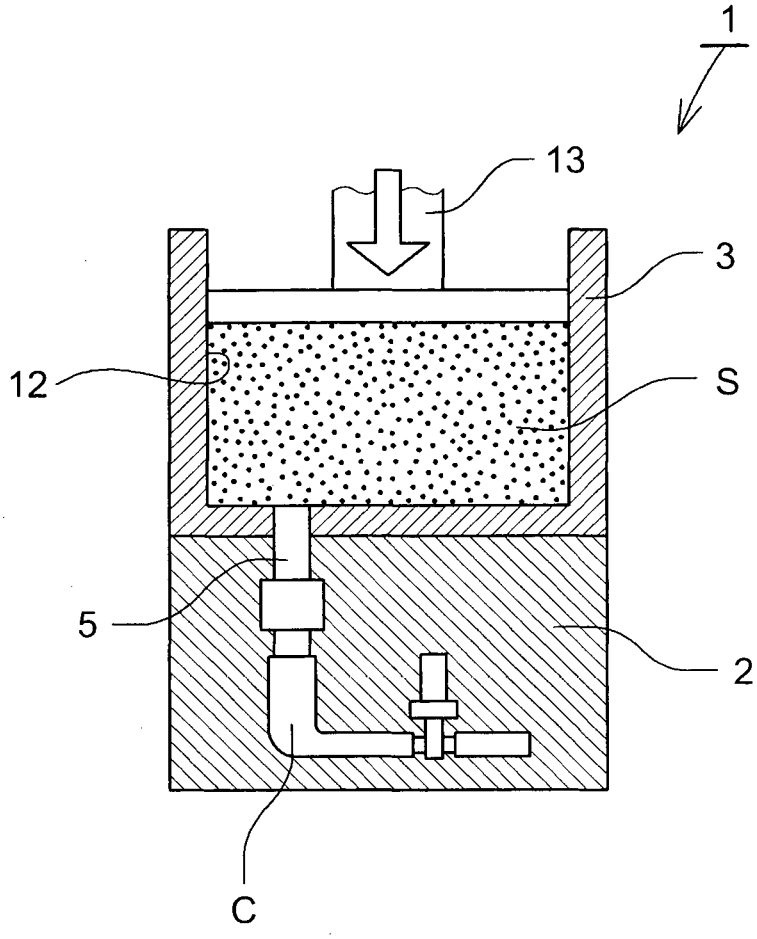
FIG. 3 is a sectional view diagrammatically illustrating an overall configuration of a sand-mold molding device of a related art that is applicable to the embodiment of the present invention.

The following describes a mode for carrying out the present invention with reference to the accompanying drawings. Note that, in this description, the same part as a constituent in a related art or an equivalent part to the constituent in the related art is indicated by the same sign as the constituent in the related art, and detailed explanations thereof are omitted. A molding method of a sand mold using foamed sand according to the embodiment of the present invention is such that a die 2 is set in a sand tank 12, and foamed sand S in the sand tank 12 is pressurized by a pressurization mechanism 13, as illustrated in FIG. 3. Hereby, the foamed sand S is filled into a cavity C of the die 2 via a filling opening 5. The die 2 is heated to around 150° C. to 300° C., so as to vaporize water in the foamed sand S filled in the cavity C, thereby solidifying the foamed sand S.

Figure 1A:
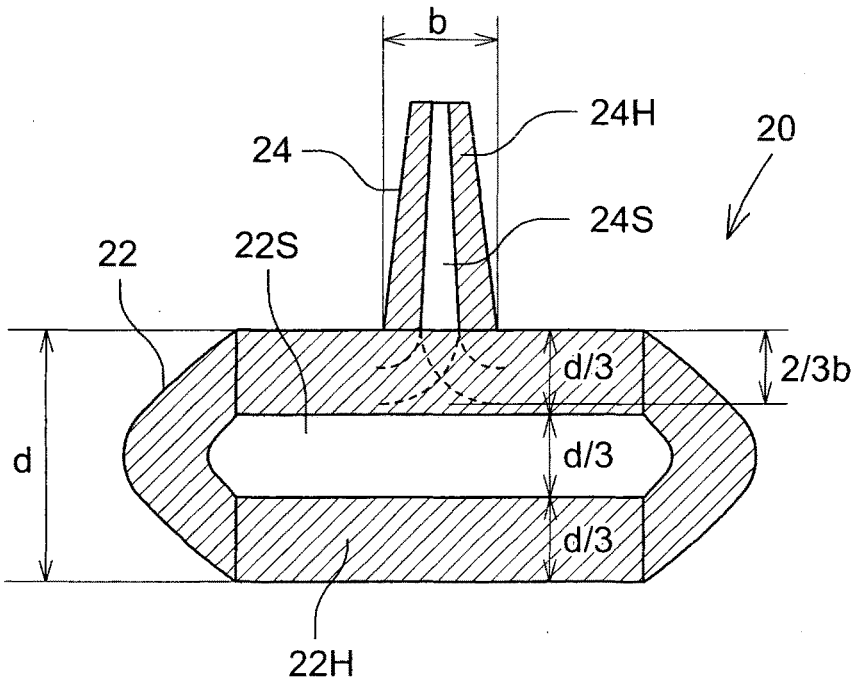
FIG. 1A is a schematic sectional view of a sand mold molded by a molding method of a sand mold using foamed sand according to an embodiment of the present invention, and illustrates a dimensional relationship between a blowing opening and a product portion of the sand mold, according to the embodiment of the present invention.

After that, the die 2 is opened and a sand core thus molded is taken out therefrom, and thus, a sand mold 20 illustrated in FIG. 1A is molded.

The sand mold 20 includes a product portion 22 molded inside the cavity C of the die 2, and a blowing opening 24 formed inside the filling opening 5. Here, the sand mold 20 is illustrated in FIG. 1A such that only an area where the blowing opening 24 projects is extracted out of the product portion 22 having a more complicated shape as a whole, so as to show its sectional view. In predetermined thickness ranges from respective outer layer parts of the product portion 22 and the blowing opening 24, hardened layers 22H, 24H are formed. Further, vulnerable portions or hollow portions 22S, 24S are formed inside the hardened layers 22H, 24H. In a process of heating and hardening of the foamed sand S, water glass and an aggregate are accumulated in an outer layer part of a molded product, so that a minute hardened layer having a necessary strength is formed in a predetermined thickness range from the outer layer part of the molded product. Due to this mechanism, the product portion 22 and the blowing opening 24 are each configured such that a thickness of the vulnerable portion or hollow portion 22S, 24S is generally one-third of a whole thickness of the product portion 22 or the blowing opening 24. Further, each of the hardened layers 22H, 24H covering the vulnerable portion or hollow portion 22S, 24S has a thickness of generally one-third of the whole thickness of the product portion 22 or the blowing opening 24.

In the embodiment of the present invention, b indicates a dimension for a largest distance between intersections of straight lines passing through a section of a boundary portion between the product portion 22 and the blowing opening 24, with respect to an outside line of the section, as illustrated in FIG. 1. The molding is performed so that the dimension b is less than a predetermined ratio with respect to a thickness dimension d of that part of the product portion 22 from which the blowing opening 24 projects. More specifically, values of b and d are set so that $b<d/2$ is satisfied.

A specific method of setting ranges of the values of b and d is as follows. As described above, in the sand mold 20 molded by the present method, the thickness of the vulnerable portion or hollow portion 24S is generally ⅓b with respect to the whole thickness b of the blowing opening 24, and the thickness of the hardened layer 24H covering the vulnerable portion or hollow portion 24S is generally ⅓b. Further, the thickness of the vulnerable portion or hollow portion 22S is generally ⅓d with respect to the thickness dimension d of that part of the product portion 22 from which the blowing opening 24 projects, and the thickness of the hardened layer 22H covering the vulnerable portion or hollow portion 22S is generally ⅓d. In the product portion 22, in order to secure a sufficient thickness for the vulnerable portion or hollow portion 22S of the product portion 22 not to be exposed in that part of the hardened layer 22H from which the blowing opening 24 is removed, the following relationship should be satisfied. That is, as illustrated in FIG. 1A, a sum ⅔b of the thickness ⅓b of the vulnerable portion or hollow portion 24S of the blowing opening 24 and the thickness ⅓b of the hardened layer 24H should be less than the thickness ⅓d of the hardened layer 22H of that part of the product portion 22 in which the blowing opening 24 is formed. When the above dimensional relationship is described briefly, it can be expressed as $\frac{2}{3}b<\frac{1}{3}d$, namely, $b<d/2$.

Further, the die 2 used to obtain the sand mold 20 in the present embodiment also has the same relationship as the dimensional relationship of the sand mold 20 illustrated in FIG. 1A. That is, the cavity C and the filling opening 5 of the die 2 are configured such that a dimension b, which is a largest dimension between two intersections of straight lines passing through a section of a boundary portion between the cavity C and the filling opening 5 (see FIG. 3), with respect to an outside line of the section, is not more than a predetermined ratio with respect to a dimension of a thickness d of that part of the sand mold 20 formed by the cavity C of the die 2 from which the blowing opening 24 projects. That is, the cavity C and the filling opening 5 of the die 2 are configured such that values of b and d satisfy $b<d/2$. Thus, the sand mold 20 illustrated in FIG. 1A can be obtained by molding a sand mold by use of the die 2 configured as such.

Figure 2A:
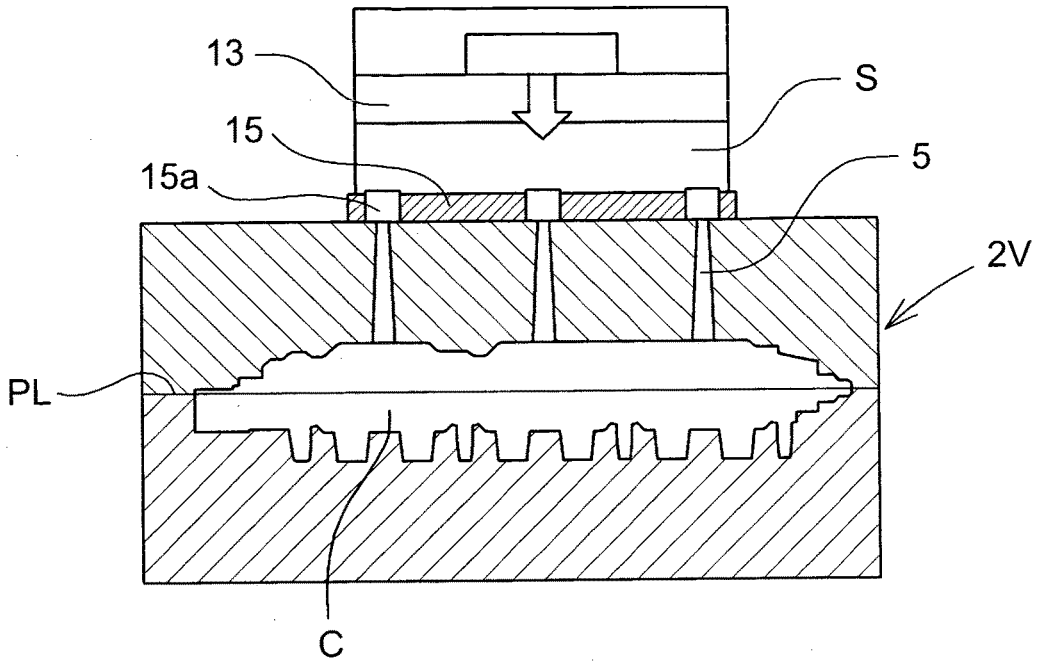
FIG. 2A is a schematic sectional view of a die and a sand-mold molding device to which the embodiment of the present invention is applicable, and illustrates an example in which the embodiment is applied to a horizontally split type.
Figure 2B:
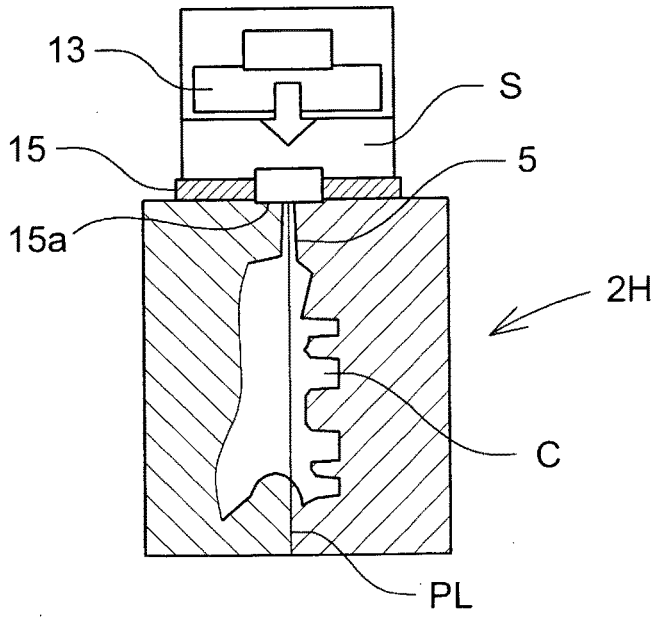
FIG. 2B is a schematic sectional view of a die and a sand-mold molding device to which the embodiment of the present invention is applicable, and illustrates an example in which the embodiment is applied to a vertically split type.

Note that the embodiment of the present invention is applicable regardless of the placement of a parting line of the die 2 to be used for molding of the sand mold 20. For example, the embodiment is applicable to a horizontally split type 2V in which a parting line PL extends laterally as illustrated in FIG. 2A, and to a vertically split type 2H in which a parting line PL extends in an up-down direction as illustrated in FIG. 2B. In FIGS. 2A, 2B, a reference sign 15 indicates a press fitting plate, and a reference sign 15*a* indicates a press fitting opening. Here, in a case where the embodiment is applied to the horizontally split type 2V, the filling opening 5 generally has a circular-cone shape, and a sectional shape of a boundary portion of the filling opening 5 with respect to the cavity C is circular. In view of this, the dimension b between two intersections of straight lines passing through the section of the boundary portion of the filling opening 5 with respect to the cavity C, and an outside line of the section is uniform and largest in any direction, in general.

On the other hand, in a case where the embodiment is applied to the vertically split type 2H, the filling opening 5 may be provided only on one die, and a sectional shape of a boundary portion of the filling opening 5 with respect to the cavity C may be asymmetric (for example, semicircular). In such a case, the sectional shape of the boundary portion of the filling opening 5 with respect to the cavity C may be asymmetric. Accordingly, the dimension b between two intersections of straight lines passing through the section of the boundary portion of the filling opening 5 with respect to the cavity C, and an outside line of the section varies depending on a direction where the straight lines passing through the section extend. In this case, the dimension b is set to a largest dimension between the two intersections of the straight lines passing through the section and the outside line of the section.

According to the embodiment of the present invention, the cavity C and the filling opening 5 of the die 2 are configured such that the dimension b, which is the largest dimension between two intersections of the straight lines passing through the section of the boundary portion between the cavity C and the filling opening 5 of the die 2, with respect to the outside line of the section, and the thickness dimension d of that part of the product portion 22 formed by the cavity C of the die 2 from which the blowing opening 24 projects satisfy $b<d/2$. Then, the foamed sand S is filled into the cavity C from the filling opening 5 of the die 2 configured as described in FIG. 3, so as to mold the sand mold 20. Hereby, the hardened layer 22H having a sufficient thickness is secured in that part of the product portion 22 from which the blowing opening 24 is removed. Accordingly, it is possible to inhibit molten metal from flowing into the vulnerable portion or hollow portion 22S of the product portion 22 at the time of casting.

Figure 1B:
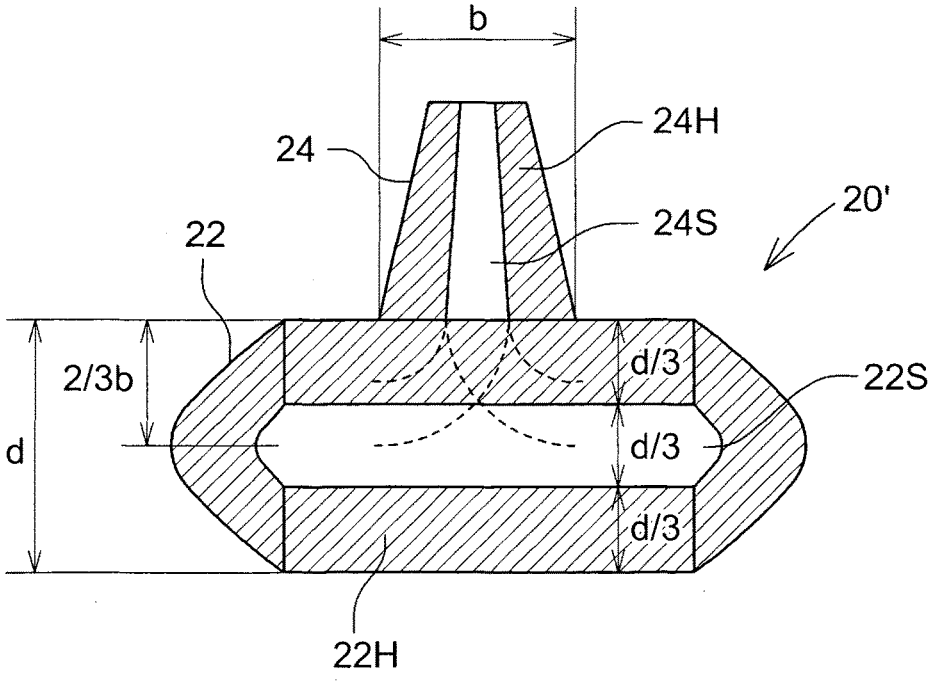
FIG. 1B illustrates a dimensional relationship between a blowing opening and a product portion of a sand mold, according to a comparative example.

Note that FIG. 1B illustrates a dimensional relationship between a blowing opening 24 and a product portion 22 of a sand mold 20', according to a comparative example relative to the embodiment of the present invention. In the comparative example, a sum ⅔b of a thickness ⅓b of a vulnerable portion or hollow portion 24S of the blowing opening 24 and a thickness ⅓b of a hardened layer 24H is set to not less than a thickness ⅓d of a hardened layer 22H of the product portion 22. When the above dimensional relationship is described briefly, it can be expressed as $\frac{2}{3}b \geq \frac{1}{3}d$, namely, $b \geq d/2$. In a case of the comparative example of FIG. 1B, the hardened layer 22H is not secured in that part of the product portion 22 from which the blowing opening 24 is removed, thereby resulting in that the vulnerable portion or hollow portion 22S is exposed. It can be understood that, according to the comparative example, it is difficult to inhibit molten metal from flowing into the vulnerable portion or hollow portion 22S of the product portion 22 at the time of casting.

What is claimed is:

1. A molding method of a sand mold including a hardened layer in a predetermined thickness range from an outer layer part, the method comprising:

forming a cavity and a filling opening of a die so that a dimension b, which is a largest dimension between two intersections of straight lines passing through a section of a boundary portion between the cavity and the filling opening of the die, with respect to an outside line of the section, is less than a predetermined ratio with respect to a thickness dimension d of a part of a product portion of the sand mold from which a blowing opening molded in the filling opening projects, the product portion being formed by the cavity of the die; and filling foamed sand into the cavity from the filling opening of the die, wherein a thickness of a vulnerable portion or hollow portion is generally ⅓b with respect to the whole thickness b of the blowing opening, a thickness of the hardened layer covering the vulnerable portion or hollow portion is generally ⅓b, a thickness of the hardened layer of the product portion is generally ⅓d, and a sum ⅔b of the thickness ⅓b of the vulnerable portion or hollow portion of the blowing opening and the thickness ⅓b of the hardened layer is less than a thickness ⅓d of the hardened layer of a part of the product portion in which the blowing opening is formed.

2. The molding method according to claim 1, wherein:

values of b and d are set so as to satisfy $b<d/2$.

3. A sand mold molded by filling foamed sand into a cavity from a filling opening of a die so that the sand mold includes a hardened layer in a predetermined thickness range from an outer layer part, the sand mold comprising:

a product portion molded in the cavity of the die; and a blowing opening molded in the filling opening, wherein a dimension b, which is a largest dimension between two intersections of straight lines passing through a section of a boundary portion between the product portion and the blowing opening, with respect to an outside line of the section is less than a predetermined ratio with respect to a thickness dimension d of a part of the product portion from which the blowing opening projects, and a thickness of a vulnerable portion or hollow portion is generally ⅓b with respect to the whole thickness b of the blowing opening, a thickness of the hardened layer covering the vulnerable portion or hollow portion is generally ⅓b, a thickness of the hardened layer of the product portion is generally ⅓d, and a sum ⅔b of the thickness ⅓b of the vulnerable portion or hollow portion of the blowing opening and the thickness ⅓b of the hardened layer is less than a thickness ⅓d of the hardened layer of a part of the product portion in which the blowing opening is formed.

4. The sand mold according to claim 3, wherein:

values of b and d are set so as to satisfy $b<d/2$.

* * * * *